US008056846B2

(12) United States Patent
Micklash, II

(10) Patent No.: US 8,056,846 B2
(45) Date of Patent: Nov. 15, 2011

(54) STIRRED BALL MILL ASSEMBLY WITH MAGNETIC DRIVE SYSTEM

(75) Inventor: Kenneth James Micklash, II, Solana Beach, CA (US)

(73) Assignee: Wildcat Discovery Technologies, San Diego, CA (US)

( * ) Notice: Subject to any disclaimer, the term of this patent is extended or adjusted under 35 U.S.C. 154(b) by 161 days.

(21) Appl. No.: 12/685,929

(22) Filed: Jan. 12, 2010

(65) Prior Publication Data

US 2011/0168820 A1 Jul. 14, 2011

(51) Int. Cl.
*B02C 17/00* (2006.01)

(52) U.S. Cl. ..... 241/137; 241/172; 241/176; 241/184

(58) Field of Classification Search ..... 241/137, 241/172, 174, 176, 179, 184
See application file for complete search history.

(56) References Cited

U.S. PATENT DOCUMENTS 3,674,218 A * 7/1972 Globus et al. ..... 241/46.06
3,698,647 A * 10/1972 Nye ..... 241/24.1
3,802,633 A * 4/1974 Schold ..... 241/72
5,183,214 A * 2/1993 Zakheim et al. ..... 241/30
5,464,163 A * 11/1995 Zoz ..... 241/172
6,976,647 B2 * 12/2005 Reed et al. ..... 241/30

* cited by examiner

*Primary Examiner* — Bena Miller
(74) *Attorney, Agent, or Firm* — Quinn Law Group, PLLC

(57) ABSTRACT

A stirred ball mill assembly includes multiple vessels each having a body supporting sets of magnets rotatable with respect to the body. Each vessel defines an enclosed milling chamber, and has a stirring arm assembly extending in the respective enclosed milling chamber and connected for rotation with the respective sets of magnets. The sets of magnets and the stirring arm assembly are completely enclosed within the respective vessel. The vessels are configured to be stacked with one another so that adjacent ones of the sets of magnets are magnetically coupled with one another. A drive motor assembly has another set of magnets magnetically coupled with one of the sets of magnets of the stacked vessels. The drive motor can rotate the stirring arm assemblies within the milling chambers of the milling chambers of the stacked vessels via magnetic coupling of the magnets.

19 Claims, 9 Drawing Sheets

STIRRED BALL MILL ASSEMBLY WITH MAGNETIC DRIVE SYSTEM

TECHNICAL FIELD

The invention relates to a stirred ball mill assembly having multiple vessels that are stirred in parallel via a magnetic drive system.

BACKGROUND OF THE INVENTION

Stirred ball mills (also known as attritors) are commonly used for material processing. They are very flexible machines that can perform mechanical alloying, grinding, particle size control and mixing. They can be configured vertically or horizontally to optimize a particular process. A stirred ball mill works by loading grinding media, which can be spherical, cylindrical, etc., into a vessel along with the material to be processed. This load is then stirred to the appropriate speeds by spinning arms driven by an externally-mounted motor. A typical stirred ball mill is limited to one reaction at a time. This means performing process optimization or running different materials has to be done sequentially, taking a great deal of time.

If the process needs to be carried out under a controlled atmosphere (e.g., with inert or a specific gas to assist the reaction or process), a seal must be made around the shaft from the driving motor to the stirring arms. If this rotating seal fails, the reaction is ruined. Also, for a small reaction, the vessel is loaded in a glove box, and if the seal is not perfect, it will leak before the user can load the cup on the stirred ball mill and connect an external gas source. Often this is prevented by placing the entire stirred ball mill in a controlled atmosphere, an expensive and cumbersome solution.

SUMMARY OF THE INVENTION

A stirred ball mill assembly is provided that includes multiple vessels each having a body supporting sets of magnets rotatable with respect to the body. Each vessel defines an enclosed milling chamber, and has a stirring arm assembly extending in the respective enclosed milling chamber and operatively connected for rotation with the respective sets of magnets. The sets of magnets and the stirring arm assembly are completely enclosed within the respective vessel. The vessels are configured to be stacked with one another so that adjacent ones of the sets of magnets are magnetically coupled with one another. The stirred ball mill assembly includes a drive motor assembly that has another set of magnets magnetically coupled with one of the sets of magnets of the stacked vessels. The drive motor can rotate the stirring arm assemblies within the milling chambers of the stacked vessels via magnetic coupling of the magnets. Because the stirring arm assemblies are completely enclosed within the separate vessels, multiple different reactions can be carried out in the different stacked vessels, and no leak paths are created that would reduce yield of the reactions. Because the stirring arm assembly does not extend outside of the vessel, there is no rotating seal past which the material can escape from the chambers.

The stirred ball mill assembly may include a base assembly configured to support the stacked vessels and the motor assembly. In at least one embodiment, the motor assembly may be slidably mounted on shafts of the base assembly, and has locating features that engage with interlocking features of the stacked vessels. This allows a single motor to stir all of the multiple vessels through magnetic coupling of the motor and the stacked vessels.

Most existing devices used for ball milling do not implement the ability to process multiple samples in parallel, instead processing material in only one milling vessel per motor. One known stirred ball mill that runs multiple vessels using only one motor uses a drivetrain (chains and sprockets, belts and pulleys, gears, etc.) to spin multiple arm shafts off of one motor. However, that design has a large space requirement as the vessels do not stack and thus require a large area to contain the device. Also, because each vessel has its own arm shaft that extends out of the vessel to the pulley, a rotating seal is necessary for each vessel. This creates multiple potential leak points between the seal and the arm shaft and increases the chance of contaminating the material.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
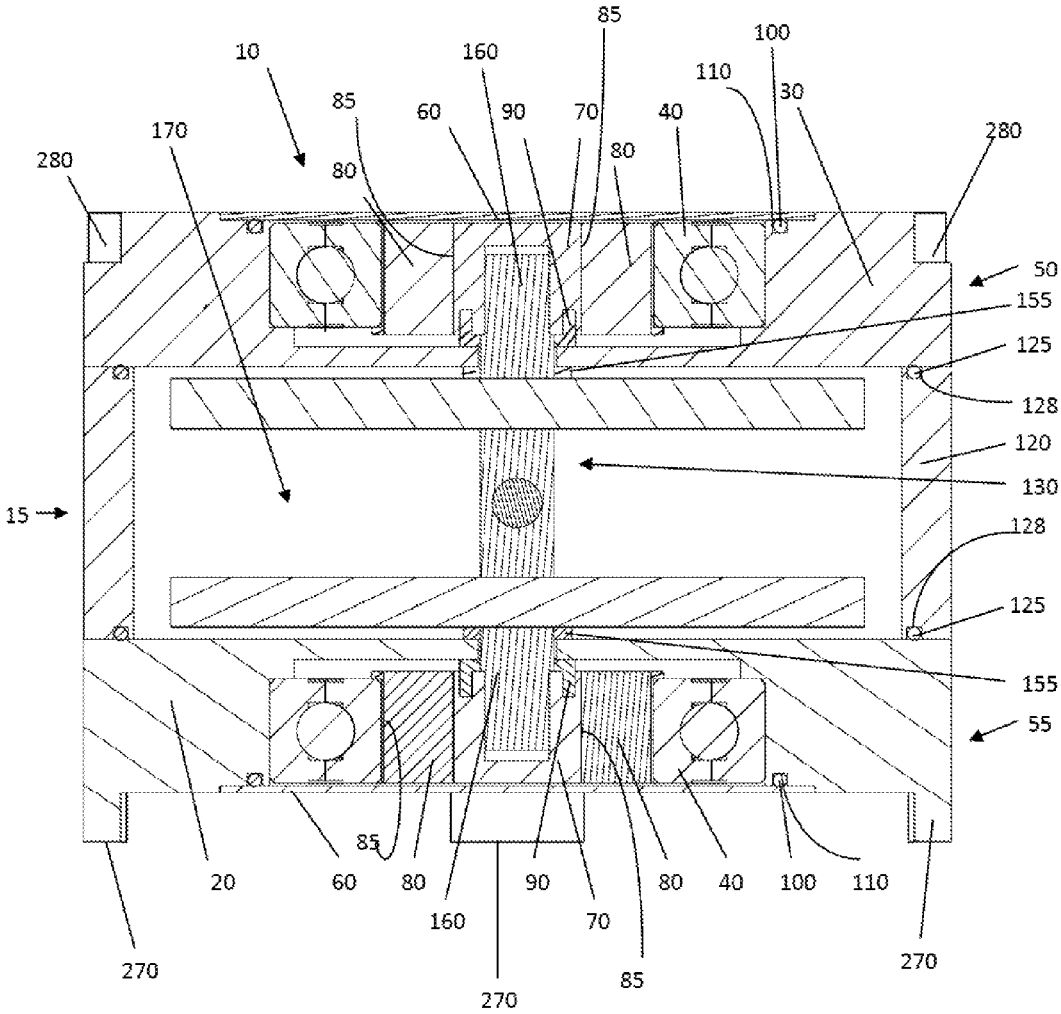
FIG. 1 is a schematic cross-sectional illustration of a milling vessel for use in a parallel stirred ball mill assembly of FIGS. 5, 7 and 8; taken at arrows 1-1 in FIG. 7.
Figure 5:
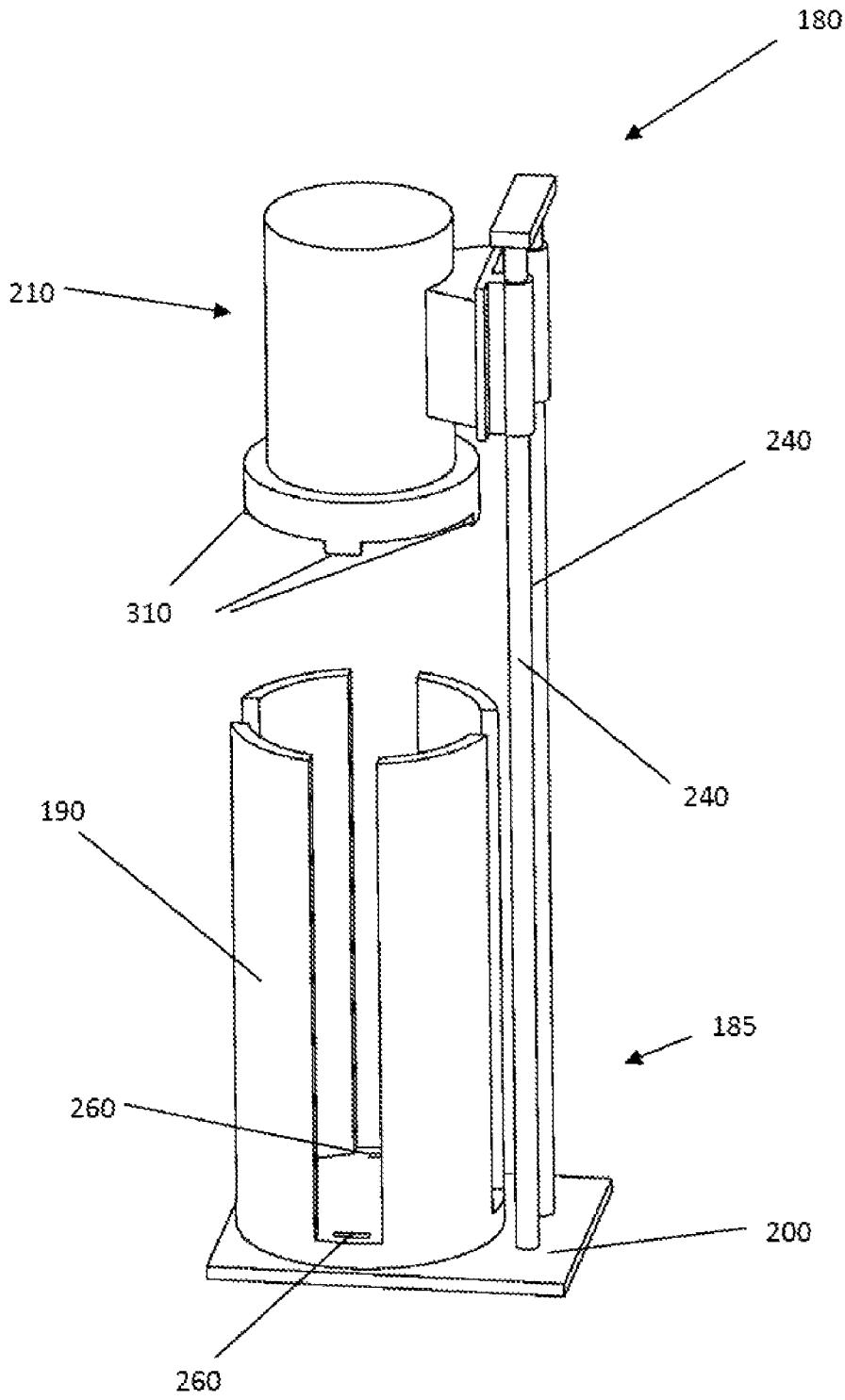
FIG. 5 is a schematic perspective view of an unloaded parallel stirred ball mill assembly in a load/unload position, including a motor assembly.
Figure 7:
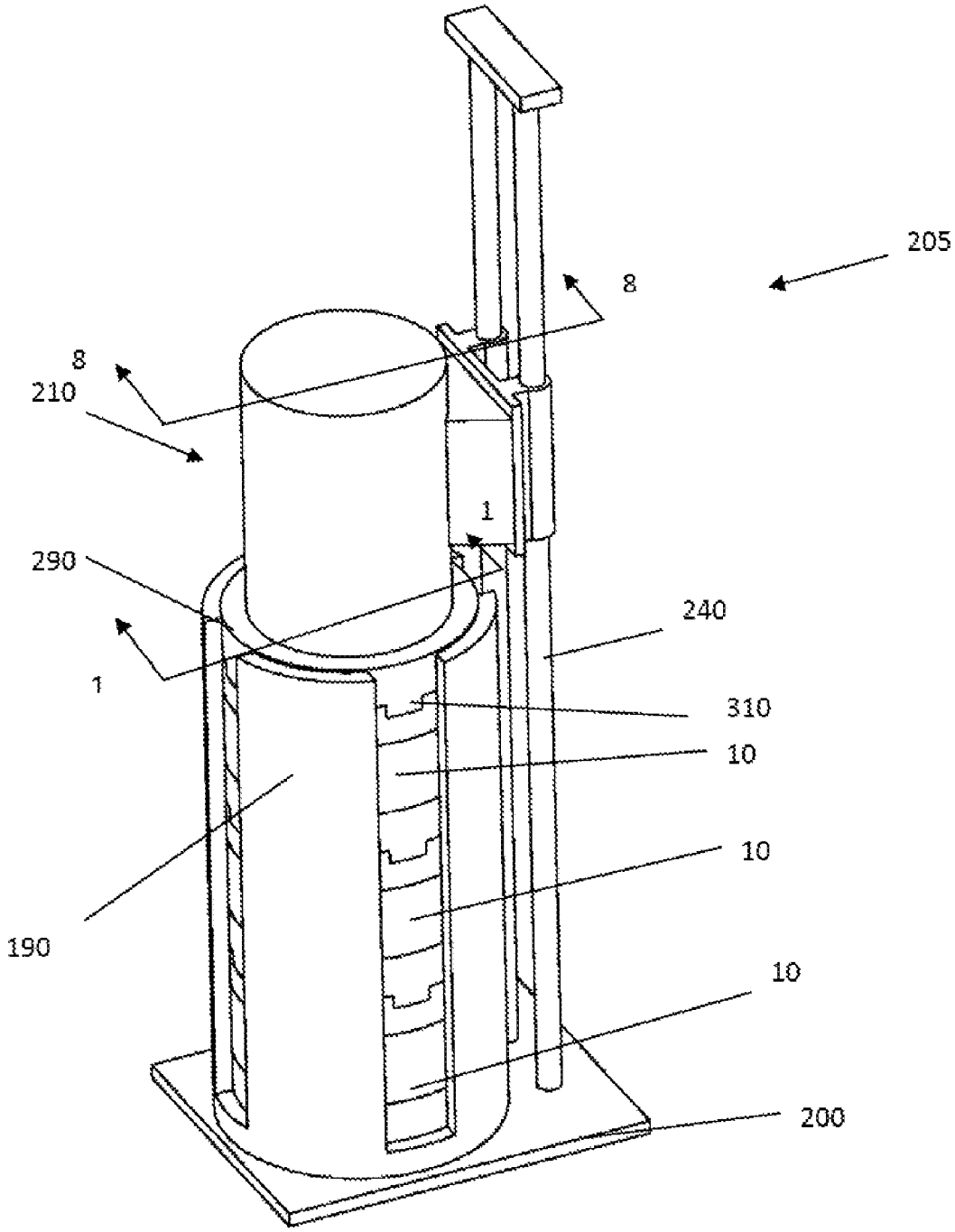
FIG. 7 is a schematic perspective view of the parallel stirred ball mill assembly of FIG. 5 fully-loaded with vessels like that of FIG. 1, and in an engaged (nm) position.

FIG. 1 shows a cross-sectional view of milling vessel 10 for use in a parallel stirred ball mill 180 shown in FIG. 5 (also referred to as a parallel attritor). As described herein, multiple vessels 10 stack for use in the parallel stirred ball mill 180 to establish a parallel stirred ball mill assembly 205, as shown in FIG. 7. Stirring of material in the vessels 10 is via a magnetic drive system, as described below.

The milling vessel 10 of FIG. 1 has a body 15 that includes two end plates: a bottom plate 20 and a top plate 30, as well as a cylindrical portion, milling cylinder 120. Bearings 40 are assembled into the plates 20, 30. The bearings 40 may be sealed ball bearings. The top plate 30 and bottom plate 20 can be made out of any material that is compatible with the synthesis to be performed (e.g., hardened tool steel, stainless steel, plastic, and ceramic). The bearings 40 are press fit into the bottom plate 20 and the top plate 30, and allow rotation of magnet carrier members 70 relative to the plates 20, 30. In alternate embodiments, the bearings 40 can be replaced with bushings made out of brass, plastic, etc. There are two carrier members 70 per vessel 10, and these are also referred to as rotatable members.

Figure 2:
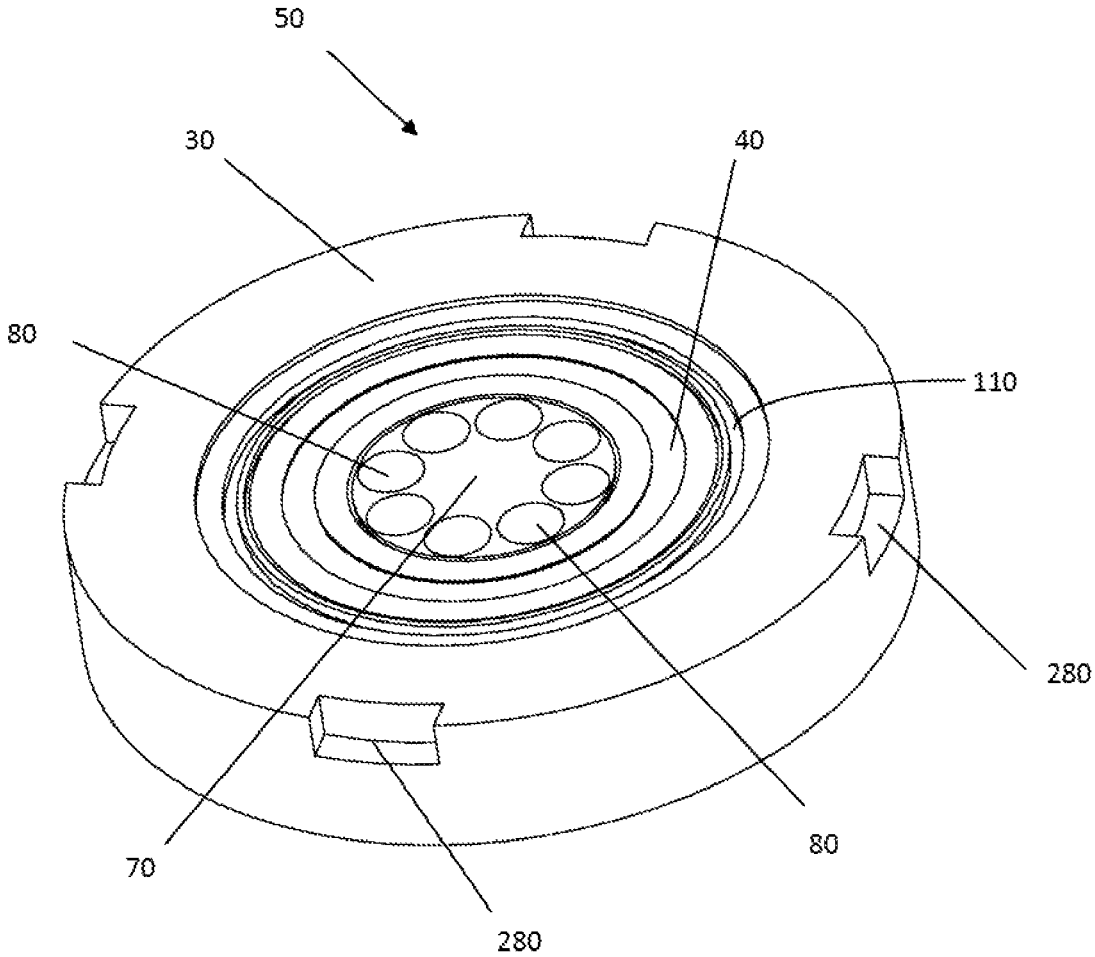
FIG. 2 is a schematic perspective view of a top assembly of the milling vessel of FIG. 1 with a cover removed.

The top plate 30 is part of a top plate assembly 50 that includes the bearings 40 and carrier member 70 covered by cover 60, as well as magnets 80 and seal members discussed below. FIG. 2 shows the top plate assembly 50 without the cover 60. The magnet carrier members 70 are pressed into the internal diameter of the bearings 40. The magnet carrier members 70 can now spin relative to the bottom plate 20 or top plate 30. First and second sets of magnets 80 are inserted into bores 85 (i.e., spaced openings) cut or otherwise formed into the respective magnet carrier members 70 of the top plate 30 and the bottom plate 20, respectively, in a circular pattern. In other embodiments, the magnets 80 may be in an alternative pattern. The magnets 80 can be held in place by adhesive, set screws, or any other method of mechanical attachment. In the embodiment shown, the magnets 80 are all installed in the same direction. That is, all are installed with their poles oriented the same way. Alternatively, the magnets 80 can be installed in an alternating manner: north, south, north, south, etc. Since the magnets 80 are fixed in magnet carrier member 70, they spin with it. The rotating magnet carrier members 70 with magnets 80 along with a drive motor assembly 210 discussed below establish a magnetic drive system that is the driving force for ball milling in the vessel 10.

Referring again to FIG. 1, the top plate assembly 50 and the equivalent bottom plate assembly 55 also each contain a sealing member, referred to herein as a secondary sealing ring 90, that is pressed or otherwise attached into a groove in magnet carrier member 70. The secondary sealing rings 90 are pressed between magnet carrier members 70 and the bottom plate 20 and top plate 30, respectively, to provide backup contaminant protection for the bearings 40. The sealing rings 90 could alternatively be lip seals. After all of the subcomponents are assembled into the top plate assembly 50 or the equivalent bottom plate assembly 55, another sealing member, o-ring 100, is placed in o-ring grooves 110 of the top plate assembly 50 and bottom plate assembly 55. Covers 60 are then attached to bottom plate 20 and top plate 30. The covers 60 can be attached using bolts or clamps, etc. Covers 60 squeeze o-rings 100 and prevent air leakage when the vessel 10 is in use.

Figure 3:
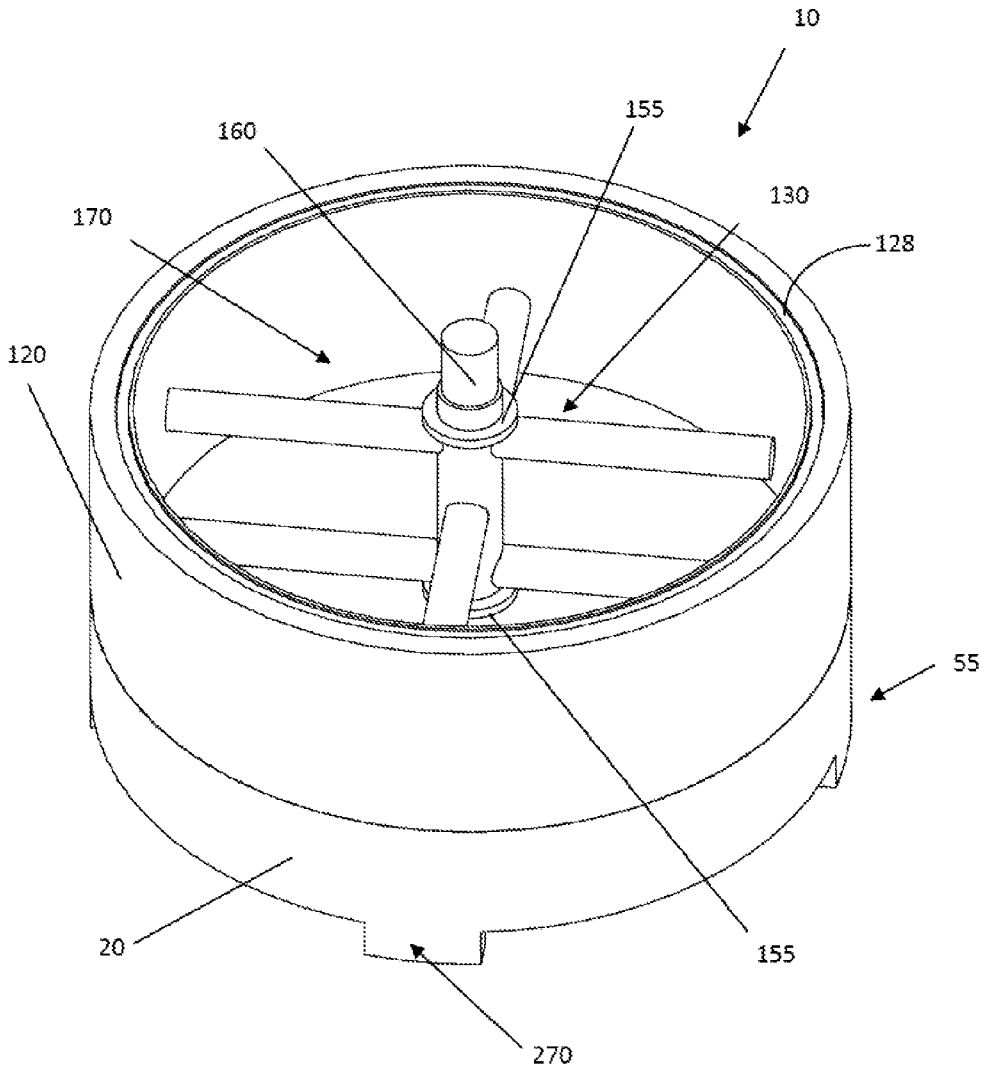
FIG. 3 is a schematic perspective illustration of the milling vessel of FIG. 1 with the top assembly removed.

FIG. 3 shows the milling vessel 10 without the top plate assembly 50. The milling cylinder 120 is attached to the bottom plate assembly 55 through the use of fasteners or clamps (or any other means of mechanical assembly) so that there is a rigid connection. The milling cylinder 120 can be made out of any material that is compatible with the material to be processed, such as hardened tool steel, stainless steel, plastic or ceramic. A sealing member, such as an o-ring 125 (shown in FIG. 1) is located in o-ring groove 128. A similar o-ring 125 is located in o-ring groove 128 of cylinder 120 adjacent the bottom plate assembly 55, as shown in FIG. 1. When the milling cylinder 120 is fixed to the top and bottom plate assemblies 50 and 55, the o-rings 125 are compressed and provide a seal between the mating components (milling cylinder 120 and bottom plate assembly 20 or top plate assembly 30, respectively).

Figure 4:
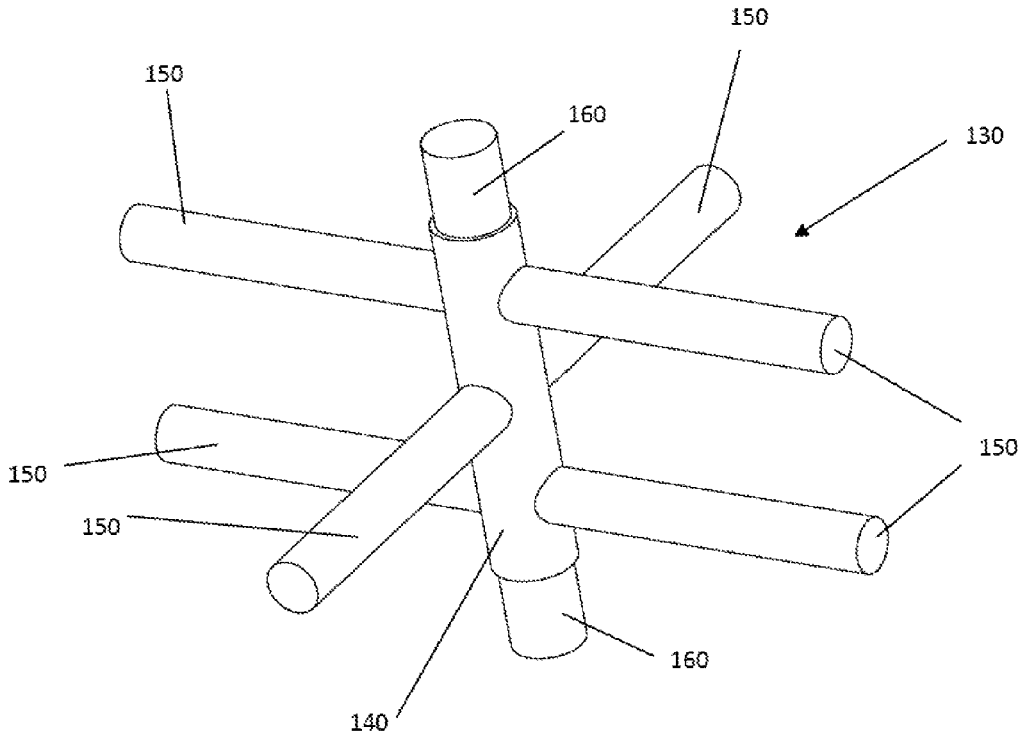
FIG. 4 is a schematic perspective illustration of a stirring arm assembly of the milling vessel of FIG. 1.

A stirring arm assembly 130, as shown in FIG. 4, is made up of a drive shaft 140 and multiple milling arms 150. The arm assembly 130 can be made out of any material that is compatible with the material to be processed, such as hardened tool steel, stainless steel, plastic or ceramic. The arm assembly 130 has the first or primary sealing rings 155 pressed onto each end. Alternatively, the lip seals could be located in the top plate 30 and bottom plate 20 and configured to seal against the rotating drive shaft 140 of the arm assembly 130. The arm assembly 130 is assembled into the magnet carrier members 70 of FIG. 1 by splines 160 on the ends of the drive shaft 140, as shown in FIG. 1, to prevent rotation of the arm assembly 130 relative to the magnet carrier members 70. Thus, the arm assembly 130 rotates with the magnet carrier members 70.

Once the bottom plate assembly 55, the milling cylinder 120 and the arm assembly 130 are assembled together, a bowl-like enclosed milling chamber 170 is formed where milling balls and raw materials can be loaded. The raw materials are generally in powder form, but could be pellets or granular. If the materials to be milled are air sensitive, the powders can be loaded with the vessel 10 in an inert atmosphere, such as in a glove box. After the milling balls and raw materials are loaded, o-ring 125 is located in o-ring groove 128 and the top plate assembly 50 is then attached by fasteners, clamps or other method of mechanical attachment. Once the entire milling vessel 10 is together (as shown in FIG. 1) it is completely sealed from the environment by the robust static o-ring seals 100 and 125. If the vessel 10 was put together in a controlled atmosphere, that atmosphere will remained sealed inside the chamber 170. Once loaded and sealed, the milling vessel 10 is ready for milling. In an alternate embodiment, a valve is included to enable the atmosphere within the chamber 170 to be changed. For example, the valve could be mounted in the top plate 30. The milling chamber 170 could then be evacuated and filled with a milling gas at higher than atmospheric pressures or left under vacuum.

FIG. 5 shows the parallel stirred ball mill 180 without any milling vessels 10 loaded onto the mill 180. The parallel stirred ball mill 180 includes a base assembly 185 that has a holder 190 for the milling vessels 10. In this embodiment, the holder 190 holds three milling vessels 10, as shown in FIG. 7, but can easily be scaled to hold a much larger number of vessels 10. If necessary for the processing conditions, coolant can be run through the holder 190 to keep the milling vessels 10 at an optimum temperature. The base assembly 185 also has a base plate 200 to which the holder 190 is mounted. The base plate 200 provides a base for the mill 180 as well as location control for all the components of the mill assembly 205.

The mill 180 also includes a motor assembly 210. The motor assembly 210 is shown in more detail in FIG. 6, and includes a motor 220, a locating plate assembly 230 and various features to interface with the milling vessels 10. The motor 220 is shown only schematically, but may be an electric motor with a stator and rotor, as is known. The motor assembly 210 is located on two guide shafts 240 of the base assembly 185 (see FIG. 5) through linear bearings 250 mounted in the locating plate assembly 230. This arrangement allows the motor assembly 210 to freely slide up and down the shafts 240 while remaining centered above the holder 190. The motor assembly 210 moves from a load/unload position (shown in FIG. 5) to the engaged (or run) position as shown in FIG. 7. In this embodiment the motor assembly 210 is moved from position to position by hand and locked in place by a screw or clamp. In other embodiments the motor assembly 210 may be driven by a motor/lead screw to automatically set its position.

Figure 6:
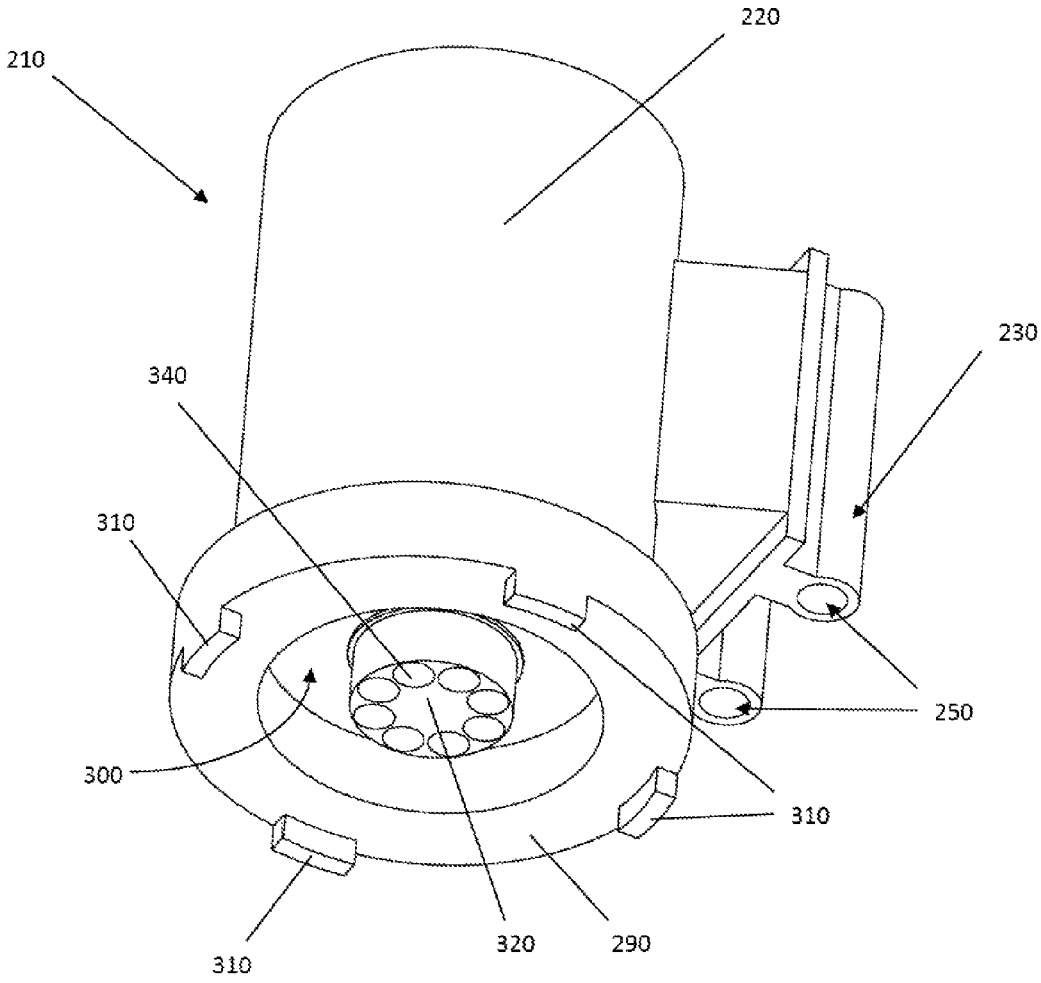
FIG. 6 is a schematic perspective view of the motor assembly of FIG. 5.
Figure 8:
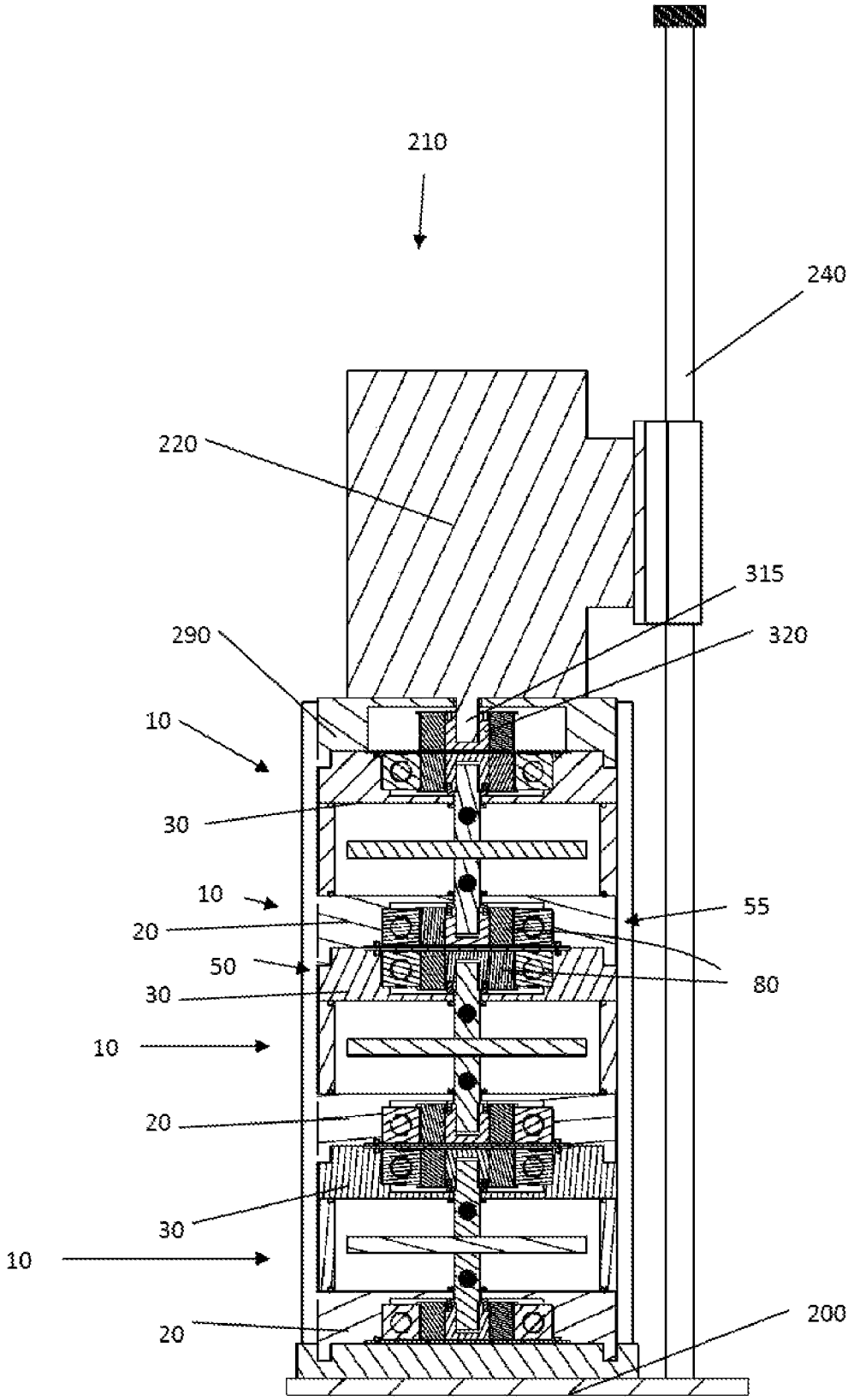
FIG. 8 is a schematic cross-sectional view of the fully-loaded parallel stirred ball mill assembly of FIG. 7 taken at lines 8-8 of FIG. 7.

When the parallel stirred ball mill 180 is in the load/unload position, milling vessels 10 can be loaded into holder 190. Holder 190 has locating features 260 cut into its bottom that mate with interlocking features, also referred to as locating fingers 270 (see FIG. 1), on the bottom plate 20 of the milling vessel 10. Top plate 30 of the milling vessel 10 also has locating interlocking features, also referred to as locating features 280, that mate with the locating fingers 270 of an adjacent bottom plate 20 when vessels 10 are stacked. As the milling vessels 10 are stacked in the holder 190 the mating locating features 280 and the locating fingers 270 interlock to prevent the stack from rotating and lock it in place. Once the milling vessels 10 are assembled into the holder 190, the motor assembly 210 is moved into the engaged (or run) position, as shown in FIG. 7. Referring to FIG. 6, the motor 220 has a motor adapter 290 rigidly attached to its front face 300. The motor adapter 290 has locating features 310 similar to locating fingers 270. Locating features 310 engage in the locating features 280 of the top plates 30 of the milling vessels 10. The locating features 310 will engage with the top plate 30 of the milling vessel 10 that is on the top of the stack in the holder 190. Once the motor assembly 210 is locked in the run position, the motor adapter 290, holder 190, and the stack of milling vessels 10 are all locked together and cannot move. FIG. 8 shows a cross sectional view of this state.

Figure 9:
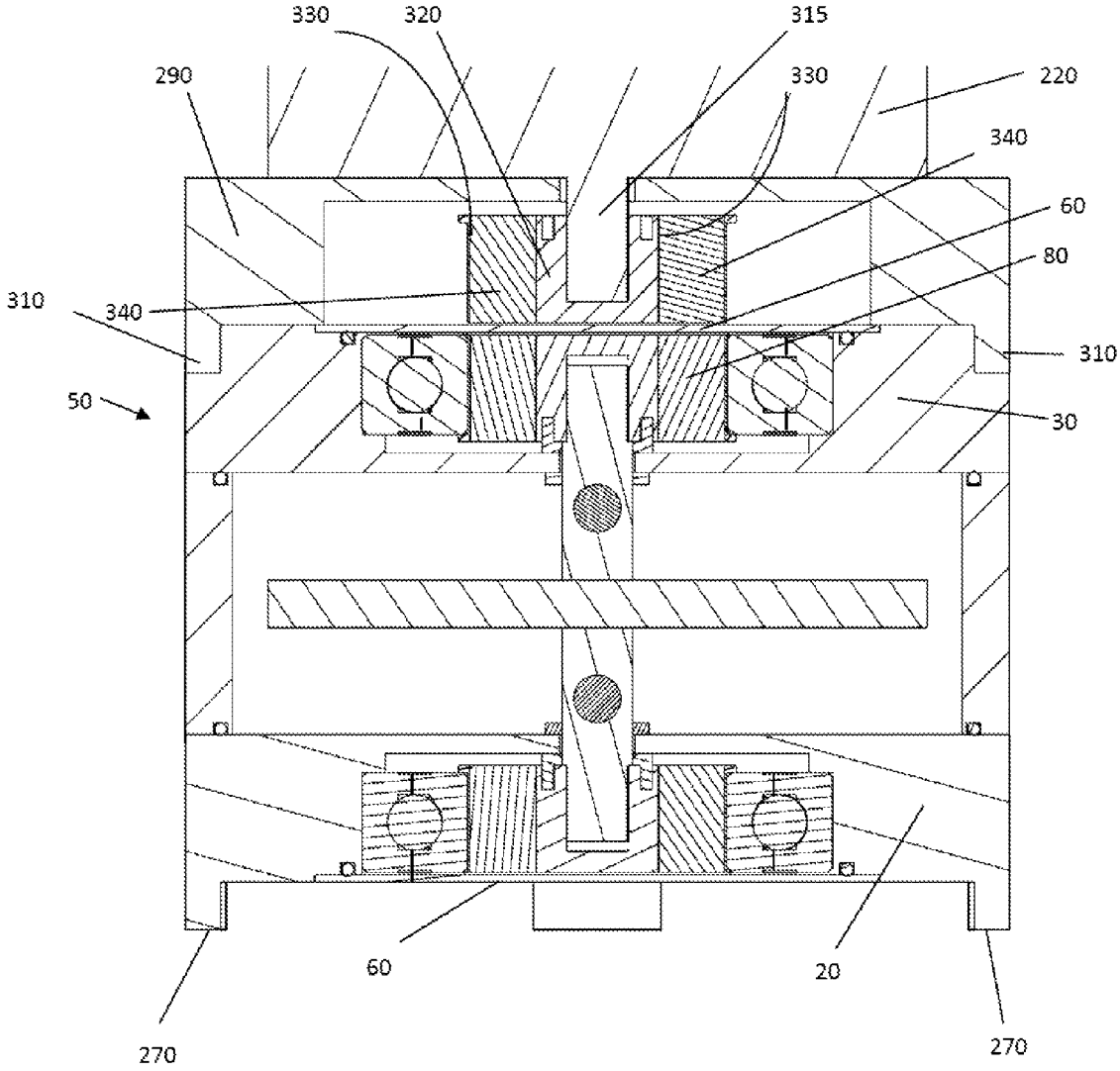
FIG. 9 is a schematic cross-sectional fragmentary view of a portion of the fully-loaded parallel stirred ball mill assembly of FIG. 8, showing the motor assembly magnetically coupled with one of the milling vessels for rotating the stirring arm assembly.

FIG. 9 shows a cross-sectional view of a portion of the motor assembly 210 engaged with the top milling vessel 10 of the stack. The motor 220 has a drive shaft 315 with a motor magnet carrier member 320 rigidly attached to the drive shaft 315. The motor magnet carrier member 320 has the same circular pattern of magnet bores 330 as does magnet carrier member 70. Magnets 340 are assembled into the magnet bores 330. The magnets 340 can be held in place by adhesive, set screws, or any other method of mechanical attachment. Since the magnets 340 are fixed in magnet carrier member 320, they spin with it. As can be seen in FIG. 9, the magnets 340 in the motor assembly 210 and the magnets 80 in the top plate assembly 50 are directly aligned over the respective magnet on the opposite part. If the magnets 80 are all installed in the magnet carrier members 70 with their poles oriented in the same direction, then all of the magnets in the motor assembly magnet carrier member 320 will also be oriented in the same direction. Magnets in the magnet carrier member 320 and the vessels 10 will be oriented so that opposite poles will face each other. For example, all the magnets 340 in the motor assembly 210 may have their north poles facing out and all the magnets 80 in the milling vessels may have their south poles facing out. Alternatively, the magnets 340 can be installed in an alternating manner: north, south, north, south, etc. if the magnets 80 of the milling vessels 10 are also oriented in this manner. Because of this alignment, the magnets 80 and magnets 340 will be attracted to each other, causing the magnet carrier members 70 and the magnet carrier member 320 to rotate together as if they were attached. To maximize the attraction, only covers 60 separate the sets of magnets 80 and 340, and the adjacent sets of magnets 80 of the top plate assembly 50 and the bottom plate assembly 55 of adjacent vessels 10. The covers 60 are optimized to be very thin, and are made out of a non-magnetic material.

When the shaft 315 of the motor 220 spins, the magnet carrier member 320 and the magnets 340 spin with it. Because of the magnetic attraction, magnet carrier members 70 also spin, which spins the arm assemblies 130 through the splines 160. The spinning of the arm assemblies 130 causes milling balls and raw materials in the milling chambers 170 to be knocked into motion by the arms 150. These impacts will then cause mechanical alloying, grinding or mixing depending on the processing conditions. Because of the magnetic drive system, there are no rotating seals that could become contaminated by powders and create a leak path out of the vessels 10. This makes the stirred ball mill assembly 205 very robust. The only rotating seals are primary sealing rings 155 and secondary sealing rings 90. Because the arm assemblies do not extend outside of the vessels, the sealing rings 90, 155 can be entirely enclosed within the vessels 10 to ensure that the material that is being processed stays in the milling chamber 170. This prevents any material from getting out of the chamber 170, which would reduce the yield of the reaction. Thus, all of the rotating seals (i.e., sealing rings 90, 155) are completely enclosed within the milling vessels 10, and the vessels 10 are sealed by robust static seals (i.e., o-ring seals 100, 125), unlike traditional attritors that are dependent upon less robust rotating seals to seal the milling vessel.

When multiple milling vessel assemblies are stacked as in FIG. 8, it can be seen that the magnets 80 in the bottom plate assembly 55 of one milling vessel 10 will be attracted to the magnets 80 in the top plate assembly 50 of the milling vessel 10 below it. In this manner, one motor 220 can drive a large stack of milling vessels 10. The magnets 80 and 340 would be selected with an appropriate strength to handle the torque of driving multiple arm assemblies 130 through all of the milling balls and raw materials. Because each milling vessel 10 is completely sealed and separate from the others, many different reactions can be run in parallel, providing a high-throughput method of mechanical synthesis. Even higher throughput can be achieved by stacking multiple milling vessels 10 and driving multiple stacks off one motor (with belts/pulleys, gears, chains/sprockets, etc.).

While the best modes for carrying out the invention have been described in detail, those familiar with the art to which this invention relates will recognize various alternative designs and embodiments for practicing the invention within the scope of the appended claims.

The invention claimed is:

1. A stirred ball mill assembly comprising:

multiple vessels each defining a milling chamber, and each having a stirring arm assembly and two sets of magnets connected for rotation with the stirring arm assembly; wherein the respective stirring arm assemblies are entirely enclosed within the respective vessels;

wherein the multiple vessels are configured to interlock with one another so that the respective sets of magnets of adjacent ones of the interlocked vessels are magnetically coupled to thereby operatively connect the stirring arm assemblies for common rotation; and a motor assembly having a drive motor and another set of magnets configured to be magnetically coupled with one of the sets of magnets of one of the interlocked vessels, the drive motor thereby rotating the stirring arm assemblies in unison within the milling chambers via the magnetically coupled motor and stirring arm assemblies.

2. The stirred ball mill assembly of claim 1, wherein each vessel has sealing members within the vessel; and wherein there are no sealing members between adjacent vessels.

3. The stirred ball mill of claim 1, wherein each vessel has a body with a cylindrical portion and two end plates; and further comprising:

carrier members supported by the respective bodies with the respective sets of magnets supported by the respective carrier members; and the end plates each supporting a respective one of the carrier members.

4. The stirred ball mill of claim 3, wherein each vessel further includes one of bearings or bushings supporting the respective carrier members for rotation relative to the respective bodies.

5. The stirred ball mill of claim 3, wherein each end plate has a respective set of interlocking features for interlocking adjacent ones of the vessels to one another.

6. The stirred ball mill assembly of claim 5, wherein the vessels are interlocked in a stack by the interlocking features; and wherein the motor assembly has locating features configured to engage with the interlocking features of one of the end plates of one of the vessels at an end of the stacked vessels.

7. A stirred ball mill assembly comprising:

multiple vessels each having a body supporting sets of magnets rotatable with respect to the body; wherein each vessel defines an enclosed milling chamber and has a respective stirring arm assembly extending in the enclosed milling chamber and connected for rotation with the respective sets of magnets; the respective sets of magnets and the stirring arm assembly being enclosed within the respective vessel;

wherein the multiple vessels are configured to be stacked with one another so that adjacent ones of the sets of magnets are magnetically coupled with one another; and a drive motor assembly having another set of magnets magnetically coupled with one of the sets of magnets of the stacked vessels, the drive motor assembly thereby rotating the stirring arm assemblies within the milling chambers of the milling chambers of the stacked vessels via magnetic coupling of the magnets.

8. The stirred ball mill of claim 7, wherein each vessel further includes carrier members having spaced openings with the respective sets of magnets within the spaced openings of the respective carrier members; and one of bearings and bushings supporting the respective carrier members for rotation relative to the respective bodies.

9. The stirred ball mill of claim 8, further comprising:

respective first sealing rings between the respective stirring arm assemblies and the respective bodies; and respective second sealing rings between the respective stirring arm assemblies and the respective carrier members.

10. The stirred ball mill of claim 8, wherein each respective stirring arm assembly is splined to the respective carrier members of the respective vessel.

11. The stirred ball mill of claim 7, wherein each respective body has a cylindrical portion and two end plates; and further comprising:

carrier members supported by the respective bodies with the respective sets of magnets supported by the respective carrier members; and the end plates each supporting a respective one of the carrier members.

12. The stirred ball mill of claim 11, wherein each end plate has a respective set of interlocking features for interlocking adjacent ones of the stacked vessels to one another.

13. The stirred ball mill of claim 11, wherein each respective body has two covers; wherein each cover encloses a respective one of the carrier members within a respective end plate.

14. The stirred ball mill of claim 13, further comprising:

respective sealing members between the respective end plates and the respective covers.

15. The stirred ball mill of claim 14, further comprising:

additional respective sealing members between the respective end plates and the respective cylindrical portions.

16. The stirred ball mill of claim 7, further comprising:

a base assembly configured to support the stacked vessels and the motor assembly.

17. The stirred ball mill of claim 16, wherein the base assembly includes at least one shaft positioned adjacent the stacked vessels; and wherein the motor assembly is slidably mounted on the at least one shaft and is configured to magnetically couple the set of magnets of the motor assembly with the one of the sets of magnets of the stacked vessels.

18. The stirred ball mill assembly of claim 7, wherein each of the vessels has interlocking features for interlocking adjacent ones of the stacked vessels to one another; and wherein the motor assembly has locating features configured to engage with the interlocking features of one of the stacked vessels at an end of the stacked vessels.

19. A stirred ball mill assembly comprising:

multiple milling vessels each having:

a body defining a milling chamber;

a rotatable stirring arm assembly sealed within the body and not extending outside of the body;

a first and a second rotatable member fit within the body and connected for rotation with the stirring arm assembly;

a first and a second set of magnets supported for rotation with the first and the second rotatable members, respectively; and wherein the bodies have features configured to interlock the vessels to one another in a stack so that the respective first set of magnets of one of the vessels is aligned with the respective second set of magnets of an adjacent one of the vessels in the stack;

a base assembly configured to support the stacked vessels;

a motor assembly having:

a housing movably mounted to the base assembly;

a rotatable drive plate configured to support another set of magnets for rotation therewith; wherein the another set of magnets supported by the drive plate are aligned with the first set of magnets of one of the vessels at an end of the stacked vessels when the housing is moved toward the stacked vessels on the base assembly to couple the drive plate with the stirring arm assembly of the one of the vessel assemblies to allow the motor assembly to rotate the stirring arm assemblies of the stacked vessel assemblies.

* * * * *